US006545235B1

(12) United States Patent
Chou

(10) Patent No.: US 6,545,235 B1
(45) Date of Patent: Apr. 8, 2003

(54) VIBRATION SWITCH WITH MOVABLE COIL SPRING CONTACT

(76) Inventor: Tien-Ming Chou, No. 41, San-Hsi 5th St., Pei Dist., Taichung City (TW)

( * ) Notice: Subject to any disclaimer, the term of this patent is extended or adjusted under 35 U.S.C. 154(b) by 0 days.

(21) Appl. No.: 10/164,414

(22) Filed: Jun. 10, 2002

(51) Int. Cl.[7] ..... H01H 35/14
(52) U.S. Cl. ..... 200/61.51; 200/61.48
(58) Field of Search ..... 200/61.45 R, 61.48, 200/61.49, 61.5, 61.51, 61.52, 61.53

(56) References Cited

U.S. PATENT DOCUMENTS 1,057,879 A * 4/1913 Quain ..... 200/61.49
1,654,931 A * 1/1928 Greene ..... 200/61.45 R
2,561,342 A * 7/1951 Collins et al. ..... 200/61.45 R
3,141,936 A * 7/1964 Boyle ..... 200/61.53
3,415,960 A * 12/1968 Kollmeyer ..... 200/61.49
3,502,832 A * 3/1970 McRoskey ..... 200/61.49
3,631,804 A * 1/1972 Anderson et al. ..... 102/273
3,649,787 A * 3/1972 Kasabian ..... 200/61.45 R
3,673,362 A * 6/1972 Carlson et al. ..... 200/61.45 R
3,731,019 A * 5/1973 Heurtebise ..... 200/61.45 R
3,731,022 A * 5/1973 Loftus ..... 200/61.49
3,781,496 A * 12/1973 Jones, Sr. ..... 200/61.45 R
3,899,649 A * 8/1975 Jenkins ..... 200/61.51
4,201,898 A * 5/1980 Jones ..... 200/61.45 R
5,786,553 A * 7/1998 Zakutin ..... 200/61.48
5,955,712 A * 9/1999 Zakutin ..... 200/61.48

* cited by examiner

*Primary Examiner*—J. R. Scott
(74) *Attorney, Agent, or Firm*—Foley & Lardner

(57) ABSTRACT

A vibration switch includes a housing with an accommodation chamber for receiving securely a deflectable electric contact body. Two electric contact terminals respectively have connecting ends adapted to be connected to a support, and contact ends disposed in the chamber and electrically insulated from each other. One contact end is disposed to anchor and is electrically connected to an anchoring end of the electric contact body. The other contact end surrounds a contact terminal end of the electric contact body such that the contact terminal end is deflected so as to contact the contact end when the housing is jerked, thereby making an electrical connection between the terminals.

9 Claims, 17 Drawing Sheets

VIBRATION SWITCH WITH MOVABLE COIL SPRING CONTACT

BACKGROUND OF THE INVENTION

1. Field of the Invention

This invention relates to a vibration switch, more particularly to a vibration switch with an axially extending deflectable electric contact body which anchors at one end to an electric contact terminal and which is deflected at the other end when jerked to contact another electric contact terminal so as to make an electrical connection between the electric contact terminals.

2. Description of the Related Art

Referring to FIGS. 1 and 2, a conventional vibration switch 1 is shown to include a housing 101 with a through hole 103 in an end wall 102 thereof, and a first electric contact terminal 104 with a contact end which is inserted into an accommodation chamber 105 in the housing 101 via the through hole 103. An insulating plug member 108 is fittingly inserted into an opening end 109 of the housing 101, and has a recess 110 for positioning the contact end of the first electric contact terminal 104. An electric contact biasing member 106 is disposed in the accommodation chamber 105, and surrounds the contact end of the first electric contact terminal 104. A rod-shaped second electric contact terminal 107 is formed integrally with and extends from the biasing member 106, and extends outwardly of the accommodation chamber 105 through a hole 111 in the plug member 108. Once the housing 101 is jerked, the biasing member 106 is deflected to contact with the contact end of the first electric contact terminal 104 so as to make an electrical connection between the first and second electric contact terminals 104,107.

However, since the second electric contact terminal 107 is formed integrally with the biasing member 106, the following drawbacks arise:

1. The biasing member 106 and the second electric contact terminal 107 are formed from a thin metal wire of a diameter about 0.15 mm. Thus, the terminal 107 is liable to break and deform.

2. The soldering operation of the terminal 107 on a support, such as a PCB (printed circuit board), is inconvenient to conduct.

3. When the vibration switch 1 is used in a moist place, the biasing member 106 is liable to oxidize, thereby resulting in unstable electrical connection of the terminals 104, 107.

4. To ensure the sensitivity of the biasing member 106, the dimension of the biasing member 106 is limited, thereby making it difficult to position the terminal 104 precisely so as to space the terminal 104 apart from the biasing member 106 in radial directions.

SUMMARY OF THE INVENTION

The object of the present invention is to provide a vibration switch which has an electric contact terminal that is not liable to deform and break, and that can be conveniently soldered onto a support, and which can provide a stable electrical connection between two electric contact terminals.

According to this invention, the vibration switch includes a housing which is adapted to be mounted on a support in an upright direction, and which has first and second side walls spaced apart from each other in a longitudinal direction transverse to the upright direction, and a surrounding wall interposed between and cooperating with the first and second side walls to confine an accommodation chamber. A first electric contact terminal has a first connecting end which extends in the upright direction and which is adapted to be connected to the support, and a first contact end which extends from the first connecting end into the accommodation chamber and which is disposed proximate to the first side wall. A second electric contact terminal is disposed to be electrically insulated from the first electric contact terminal, and has a second connecting end which extends in the upright direction and which is adapted to be connected to the support, and a second contact end which extends from the second connecting end in the longitudinal direction and into the accommodation chamber, which is disposed adjacent to the second sidewall, and which is spaced apart from the first side wall. A deflectable electric contact body is disposed in the accommodation chamber, and has an anchoring end which anchors on and which is electrically connected to the first contact end, and a deflectable segment which extends from the anchoring end along an axis in the longitudinal direction towards the second side wall and which terminates at a contact terminal end. The deflectable segment is made from a material with a biasing force such that, by means of the biasing force against weight of the deflectable segment, the contact terminal end is held along the axis so as to be spaced apart from the second contact end in radial directions relative to the axis. When the housing is jerked, the contact terminal end is deflected in the radial directions as a result of an inertial force of the deflectable segment so as to contact the second contact end, thereby making an electrical connection between the first and second electric contact terminals.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
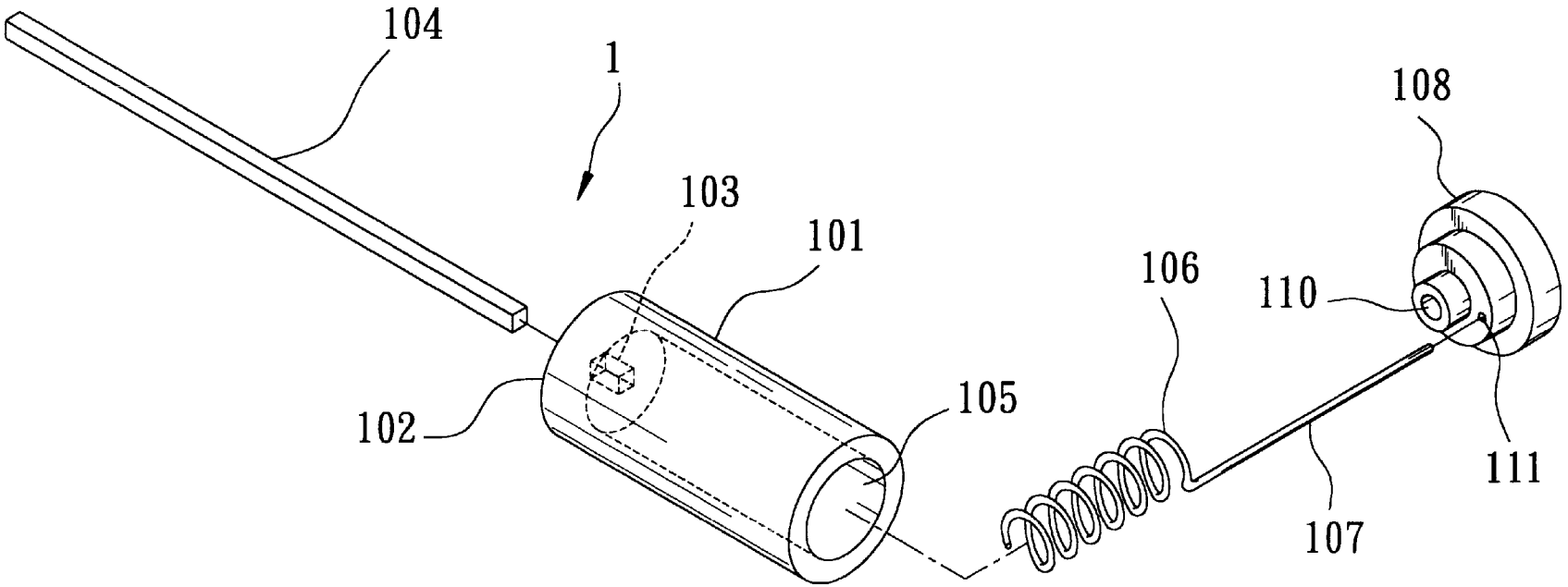
FIG. 1 PRIOR ART
FIG. 1 is an exploded perspective view of a conventional vibration switch.
Figure 2:
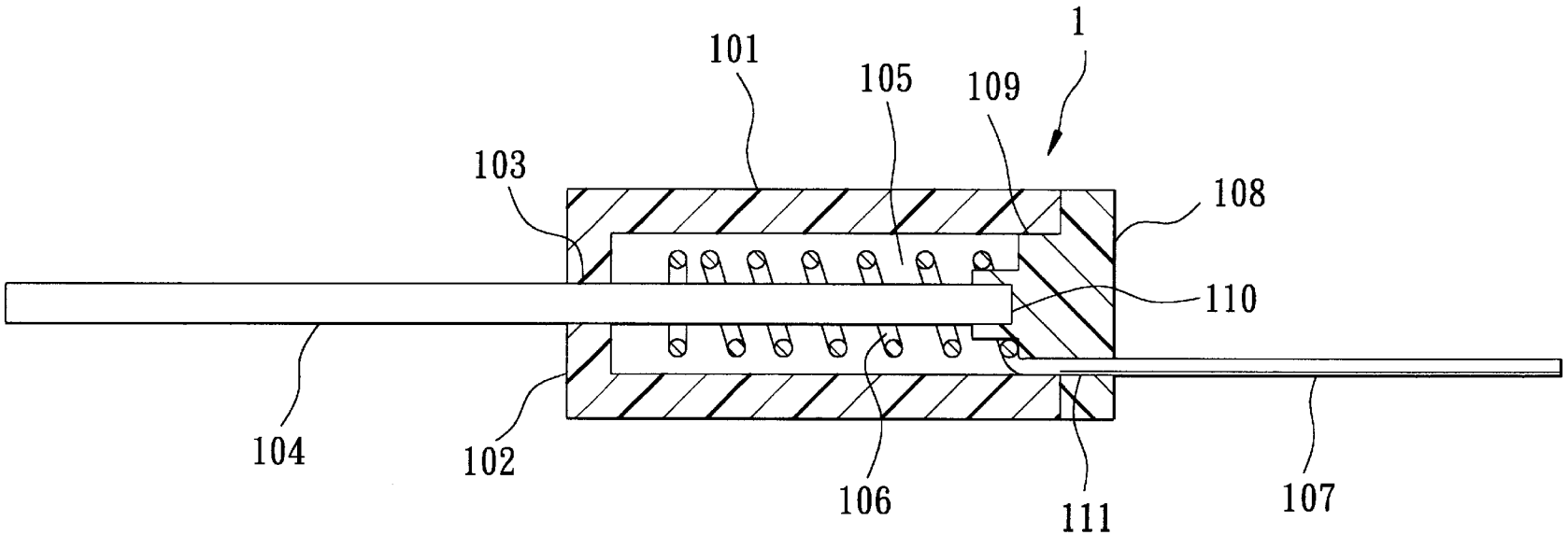
FIG. 2 PRIOR ART
FIG. 2 is a sectional view of the conventional vibration switch.

Before the present invention is described in greater detail, it should be noted that same reference numerals have been used to denote like elements throughout the specification.

Figure 3:
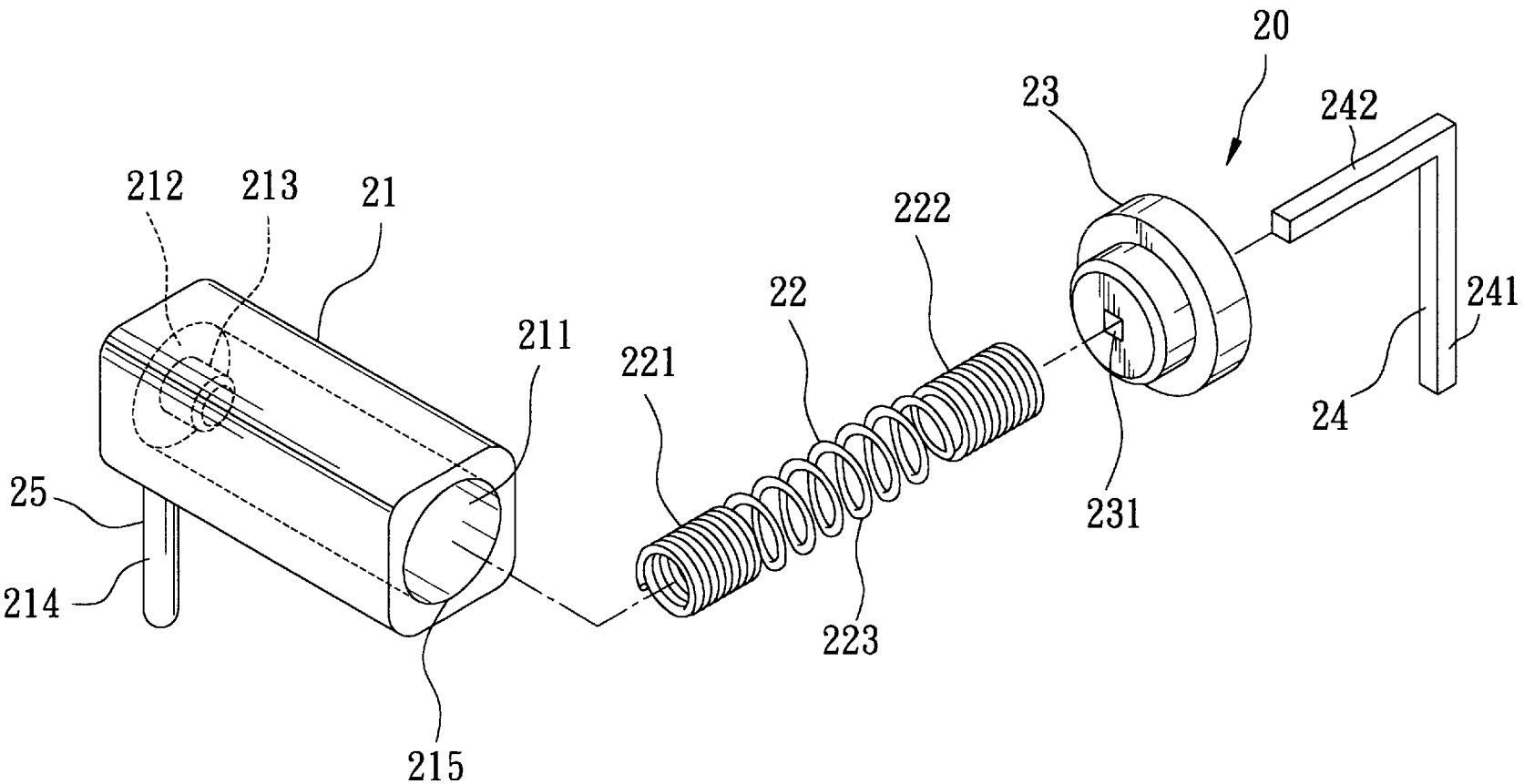
FIG. 3 is an exploded perspective view of a first preferred embodiment of a vibration switch according to this invention.
Figure 4:
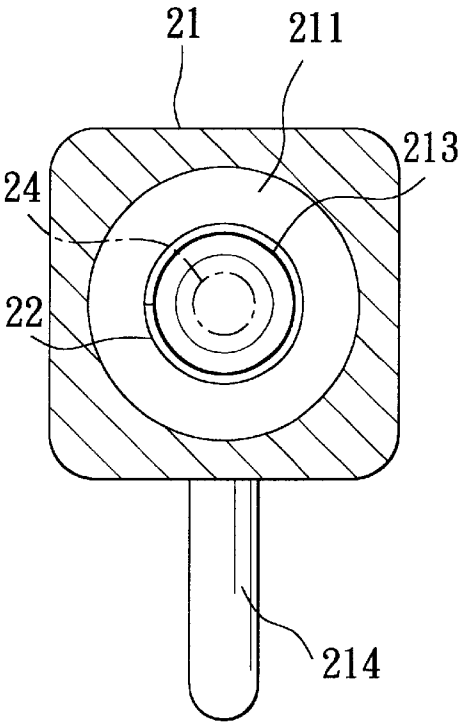
FIG. 4 is a schematic side view of the first preferred embodiment.
Figure 5:
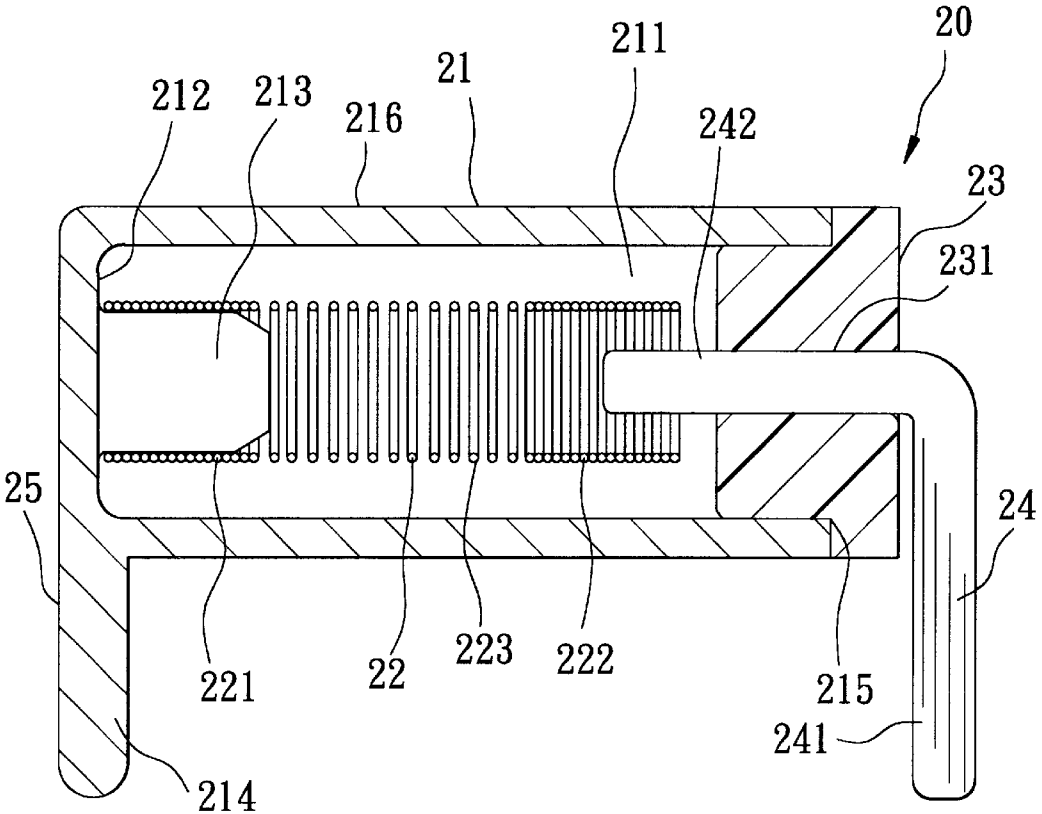
FIGS. 5 and 6 are sectional views of the first preferred embodiment in switch-off and switch-on states, respectively.

Referring to FIGS. 3, 4 and 5, the first preferred embodiment of a vibration switch 20 according to the present invention is shown to comprise a housing 21, a plug member 23, a biasing deflectable electric contact body 22, and first and second electric contact terminals 25,24.

The housing 21 is made from an electrically conductive metal material, and is adapted to be mounted on a support (not shown) in an upright direction. The housing 21 has a first side wall 212 and a surrounding wall 216 which extends from the first side wall 212 in a longitudinal direction transverse to the upright direction so as to cooperatively confine an accommodation chamber 211 with an opening end 215 opposite to the first side wall 212. The plug member 23 is made from an insulating material, and is fittingly inserted into the opening end 215 to form a second side wall of the housing 21. The plug member 23 has a through hole 231 formed therethrough along an axis in the longitudinal direction.

The first electric contact terminal 25 is formed integrally with the first side wall 212. The first electric contact terminal 25 has a first connecting end 214 which extends from the first side wall 212 downwardly and in the upright direction and which is adapted to be connected to the support, and a first contact end which is a plug portion 213 that is disposed in the accommodation chamber 211 and that extends from the first side wall 212 along the axis towards the plug member 23.

The second electric contact terminal 24 is disposed to be electrically insulated from the first electric contact member 25, and has a second connecting end 241 which extends in the upright direction and which is adapted to be connected to the support, and a second contact end 242 which extends from the second connecting end 241 along the axis and through the through hole 231 into the accommodation chamber 211.

The electric contact body 22, such as a coil spring made from an electrically conductive material, is disposed in the accommodation chamber 211. The coil spring 22 includes a plurality of loops wound spirally about the axis. The coil spring 22 has an anchoring end 221 with loops which are sleeved on and anchor to the plug portion 213, and a deflectable segment 223 which extends from the anchoring end 221 along the axis towards the plug member 23 and which terminates at a contact terminal end 222. By virtue of the biasing force of the deflectable segment 223 against the weight thereof, the contact terminal end 222 is held along the axis such that the loops at the contact terminal end 222 surround the second contact end 242. Preferably, a first distance confined between two adjacent loops at the deflectable segment 223 along the axis is larger than a second distance confined between two adjacent loops at the contact terminal end 222 so as to enhance the sensitivity of the contact terminal end 222.

Figure 6:
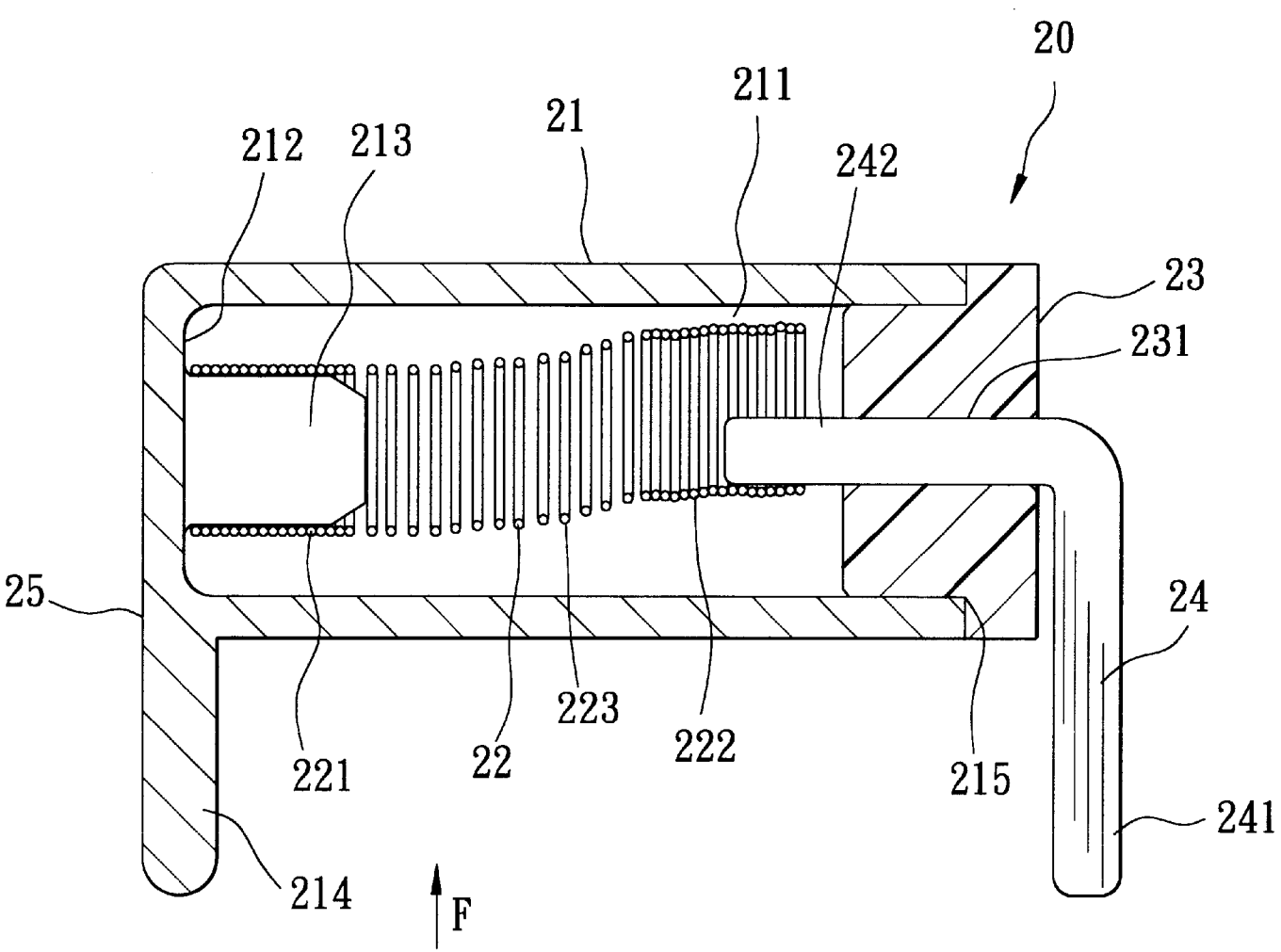

As shown in FIG. 6, when the housing 21 is jerked by means of a force (F), the contact terminal end 222 is deflected in radial directions relative to the axis as a result of an inertial force of the deflectable segment 223 so as to contact the second contact end 242, thereby making an electrical connection between the first and second electric contact terminals 25,24.

Figure 7:
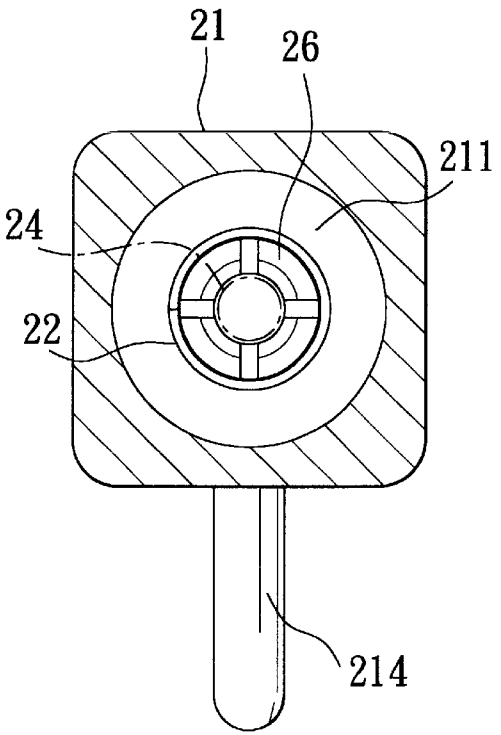
FIG. 7 is a schematic side view of a second preferred embodiment of the vibration switch according to this invention.
Figure 8:
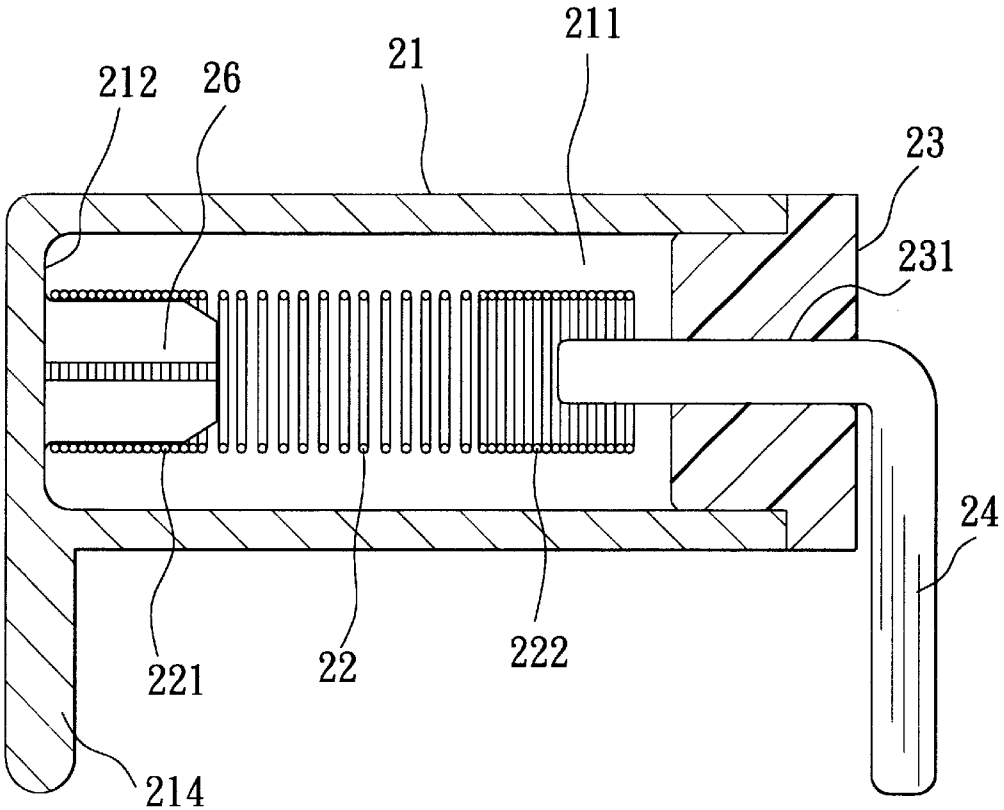
FIGS. 8 and 9 are sectional views of the second preferred embodiment in switch-off and switch-on states, respectively.
Figure 9:
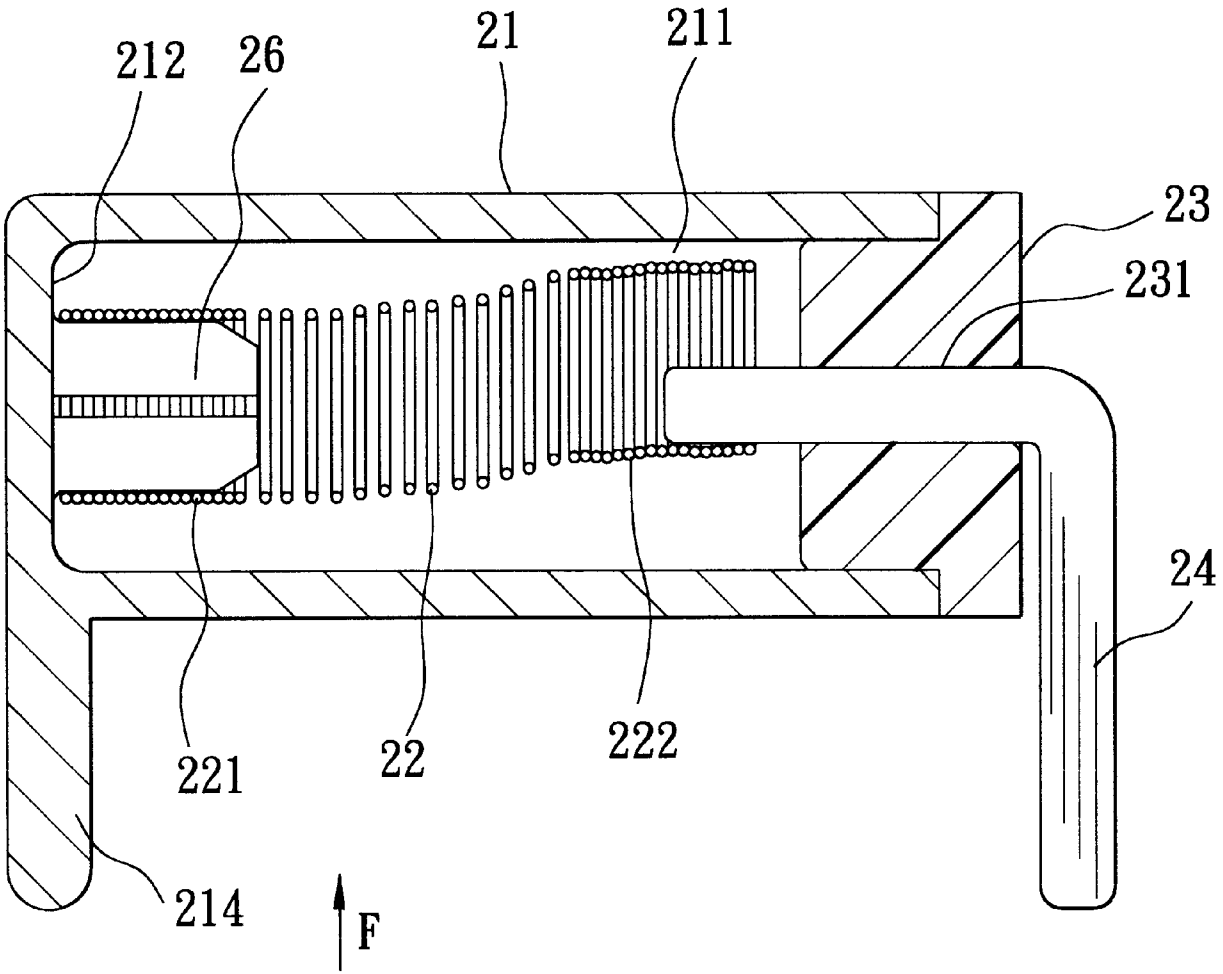

Referring to FIGS. 7 to 9, the second preferred embodiment of the vibration switch according to this invention is shown to be similar to the aforesaid first preferred embodiment in construction, except that the plug portion 26 of the first electric contact terminal includes four fin portions which are angularly displaced from one another about the axis so as to be press-fitted in the loops at the anchoring end 221 of the coil spring 22 along the axis by means of a tool (not shown). Since the operation of the vibration switch of this embodiment is similar to that of the first preferred embodiment, a description thereof is omitted herein for the sake of brevity.

Figure 10:
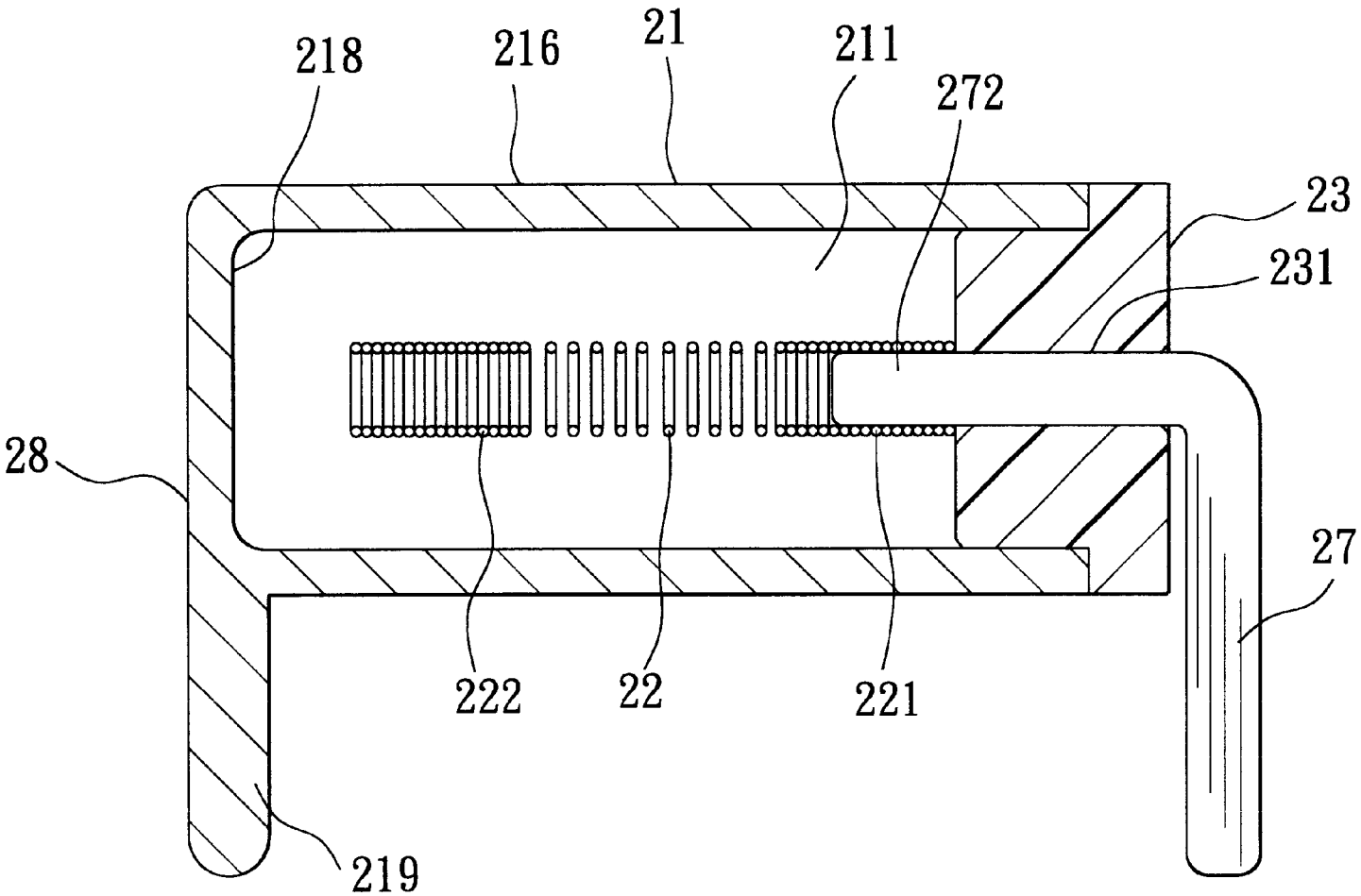
FIGS. 10 and 11 are sectional views of a third preferred embodiment of the vibration switch according to this invention in switch-off and switch-on states, respectively.
Figure 11:
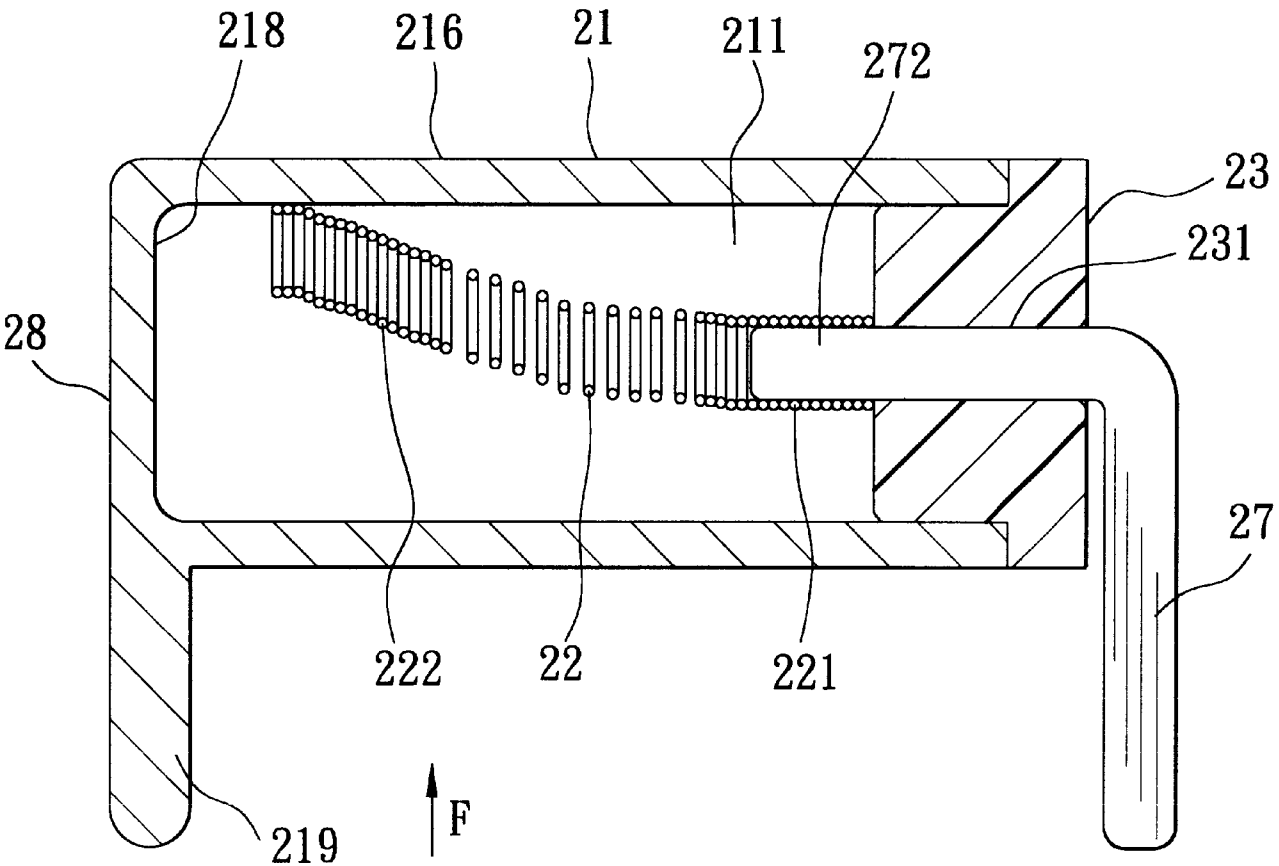
Figure 12:
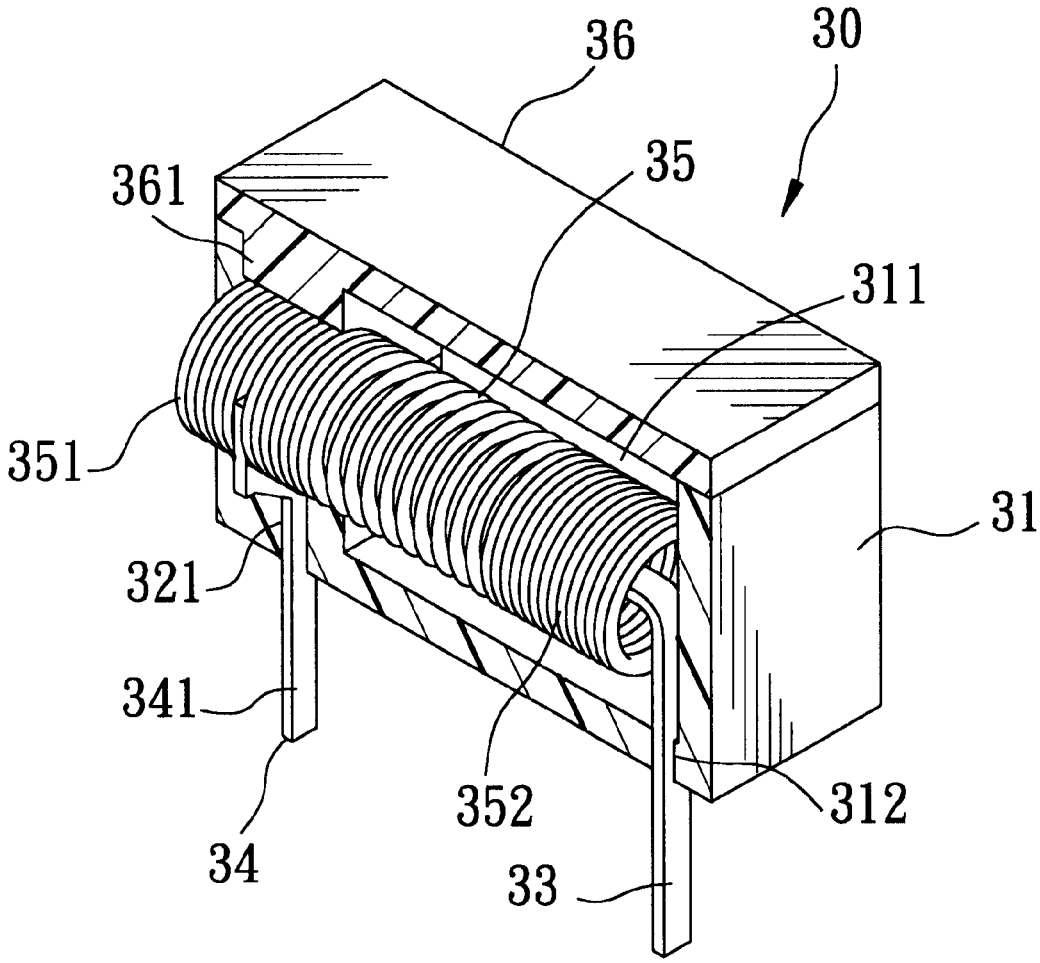
FIG. 12 is a fragmentary perspective view of a fourth preferred embodiment of the vibration switch according to this invention.
Figure 13:
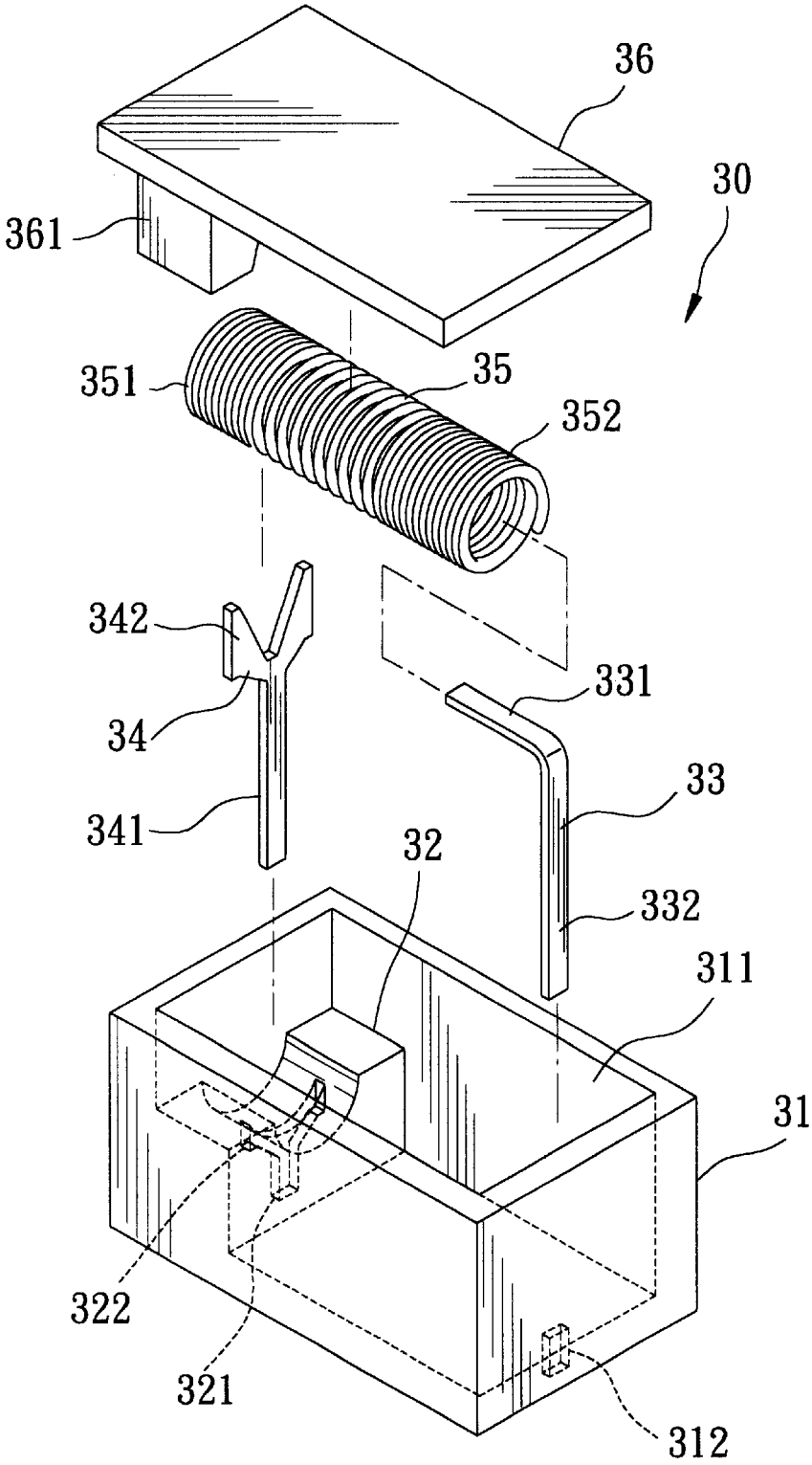
FIG. 13 is an exploded perspective view of the fourth preferred embodiment.
Figure 14:
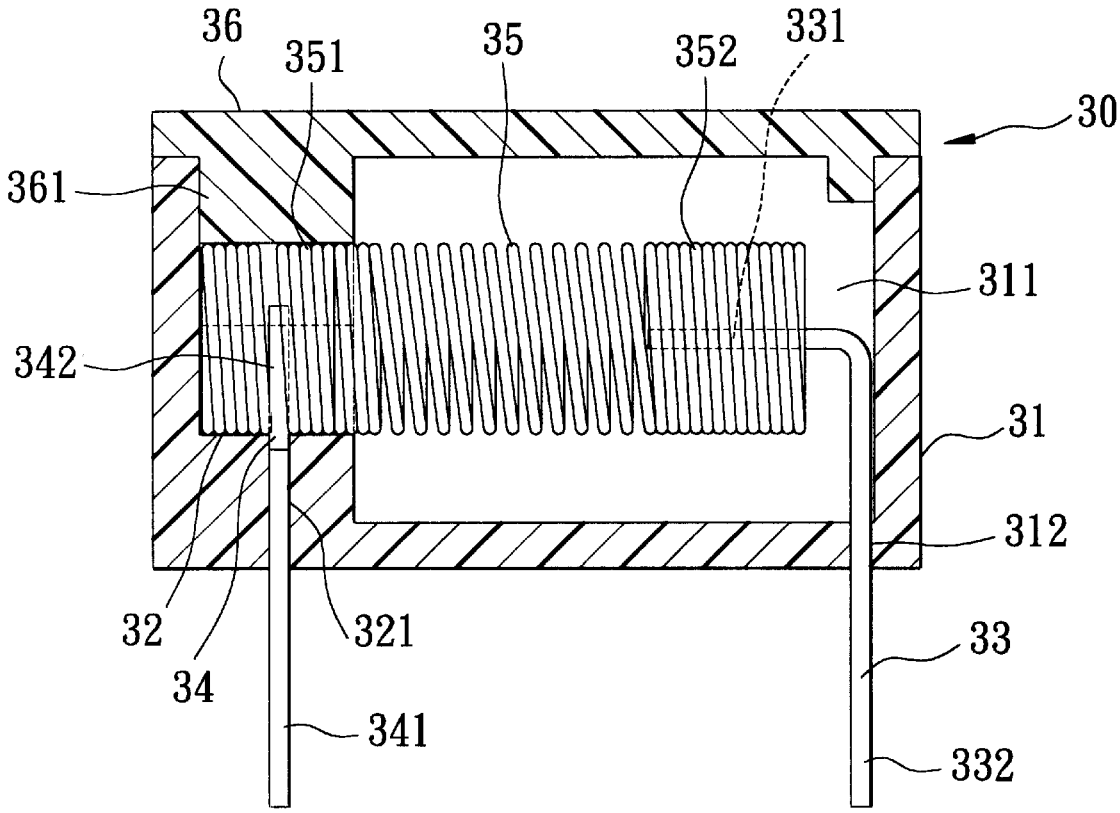
FIGS. 14 and 15 are sectional views of the fourth preferred embodiment in switch-off and switch-on states, respectively.

Referring to FIGS. 10 and 11, the third preferred embodiment of the vibration switch according to this invention is shown to include an electrically conductive housing 21, an insulating plug member 23, first and second electric contact terminals 27,28, and a biasing deflectable electric contact body 22. The first electric contact terminal 27 has a rod-like first contact end 272 which extends along the axis and through the through hole 231 in the plug member 23 into the accommodation chamber 211 of the housing 21 such that the loops at the anchoring end 221 of the electric contact body 22 are sleeved on and anchor to the first contact end 272. The second electric contact terminal 28 has a second contact end which is disposed on an inner wall surface of the surrounding wall 216 of the housing 21, and a second connecting end 219 which is formed integrally with and which extends downwardly from the second side wall 218 of the housing 21. Once the housing 21 is jerked by means of a force (F), the contact terminal end 222 of the electric contact body 22 is deflected so as to contact the second contact end on the inner wall surface of the surrounding wall 216, as shown in FIG. 11.

Referring to FIGS. 12 to 15, the fourth preferred embodiment of the vibration switch 30 according to this invention is shown to include an insulating housing 31, first and second electric contact terminals 34,33, and a biasing deflectable electric contact body 35.

Figure 15:
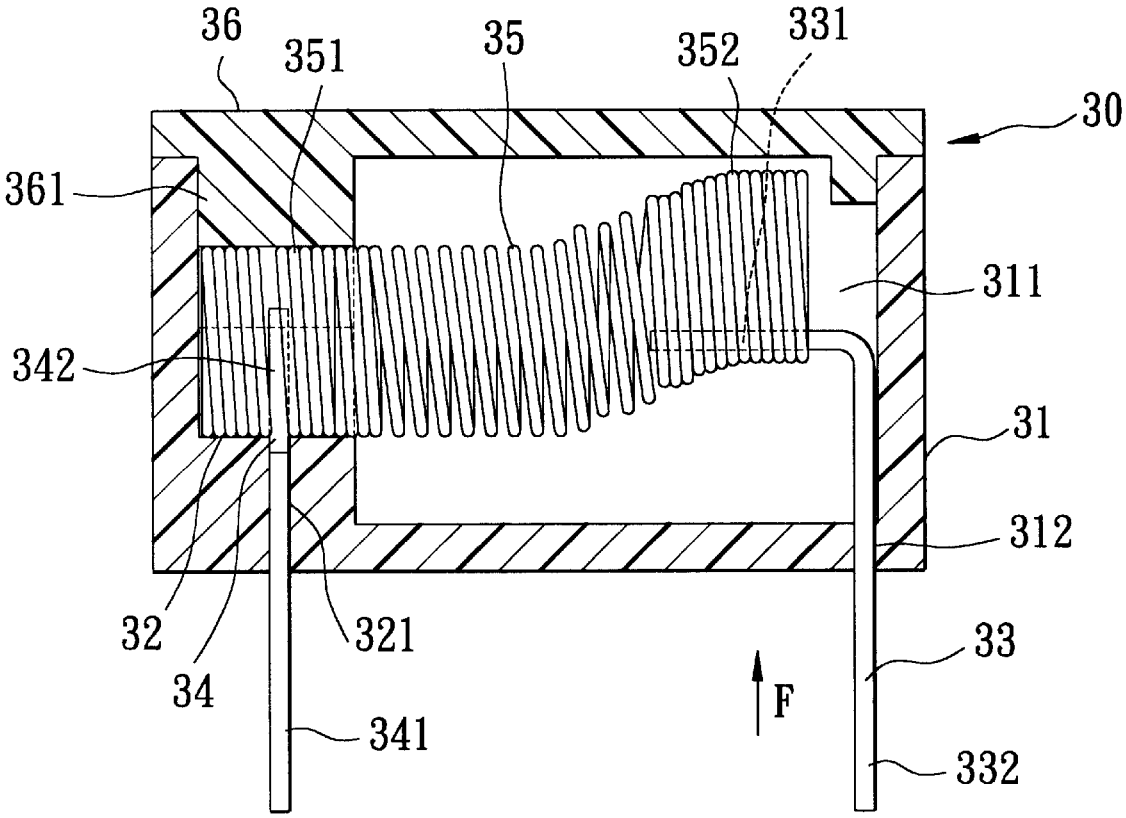
Figure 16:
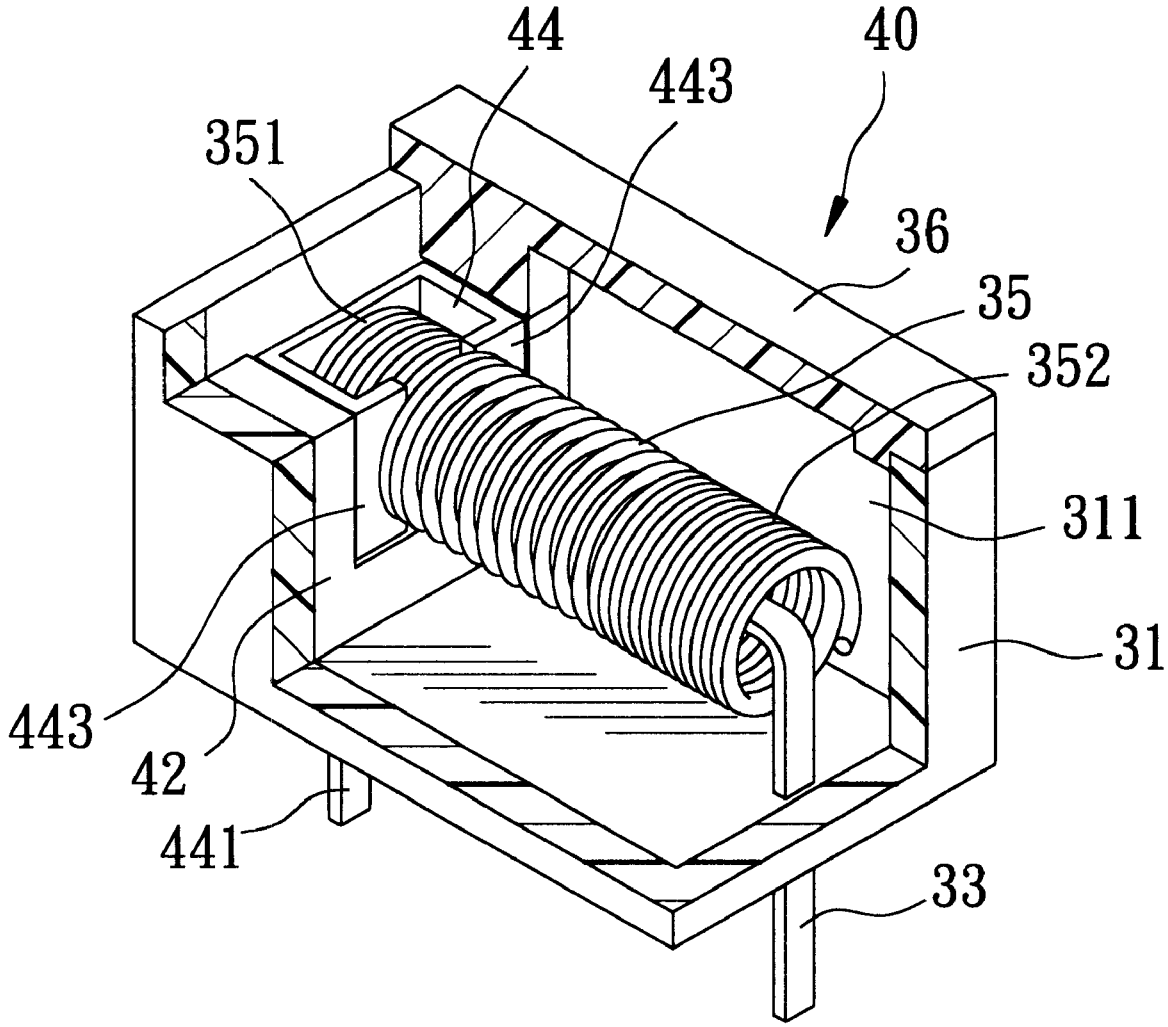
FIG. 16 is a fragmentary perspective view of a fifth preferred embodiment of the vibration switch according to this invention.
Figure 17:
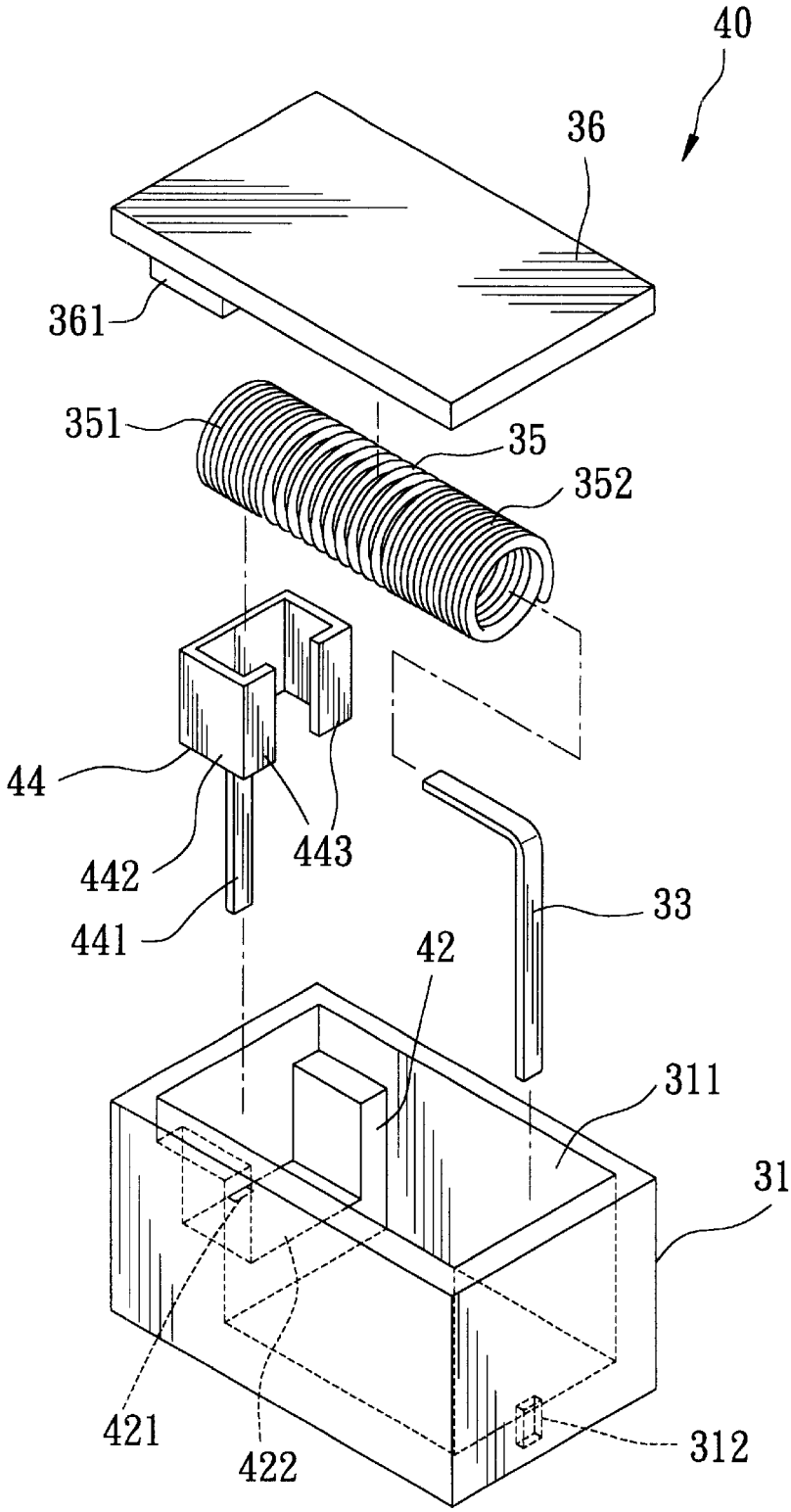
FIG. 17 is an exploded perspective view of the fifth preferred embodiment.
Figure 18:
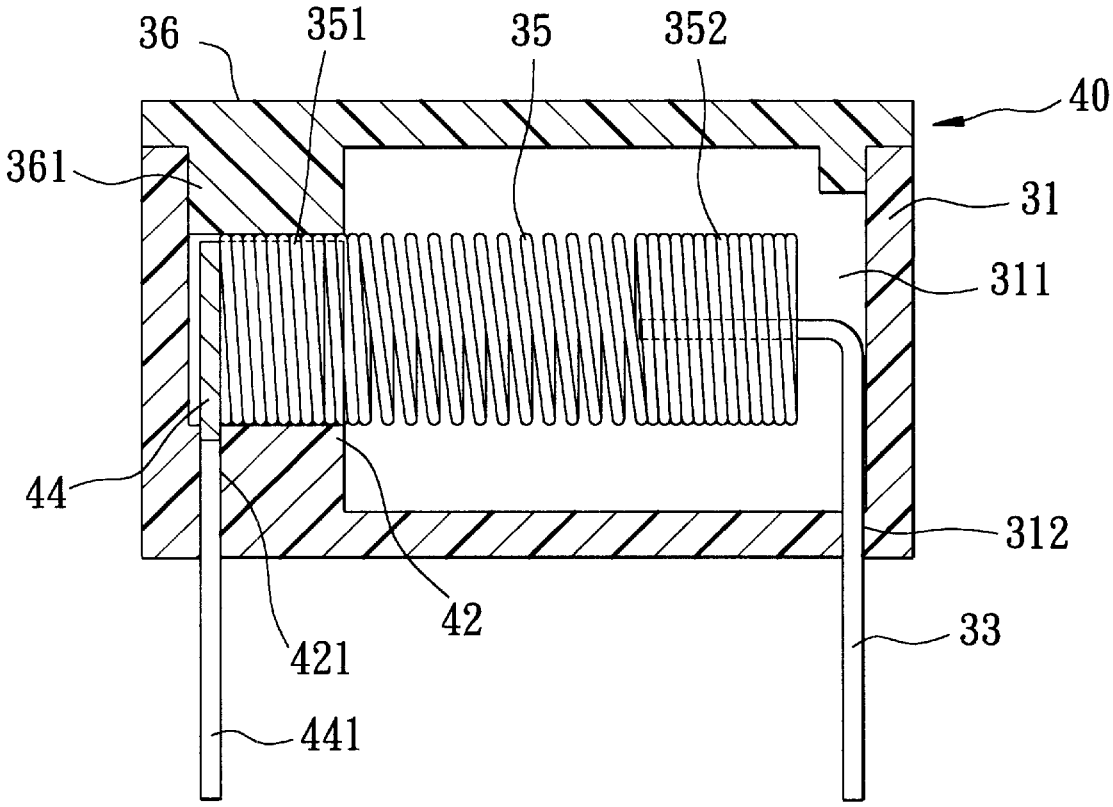
FIGS. 18 and 19 are sectional views of the fifth preferred embodiment in switch-off and switch-on states, respectively.
Figure 19:
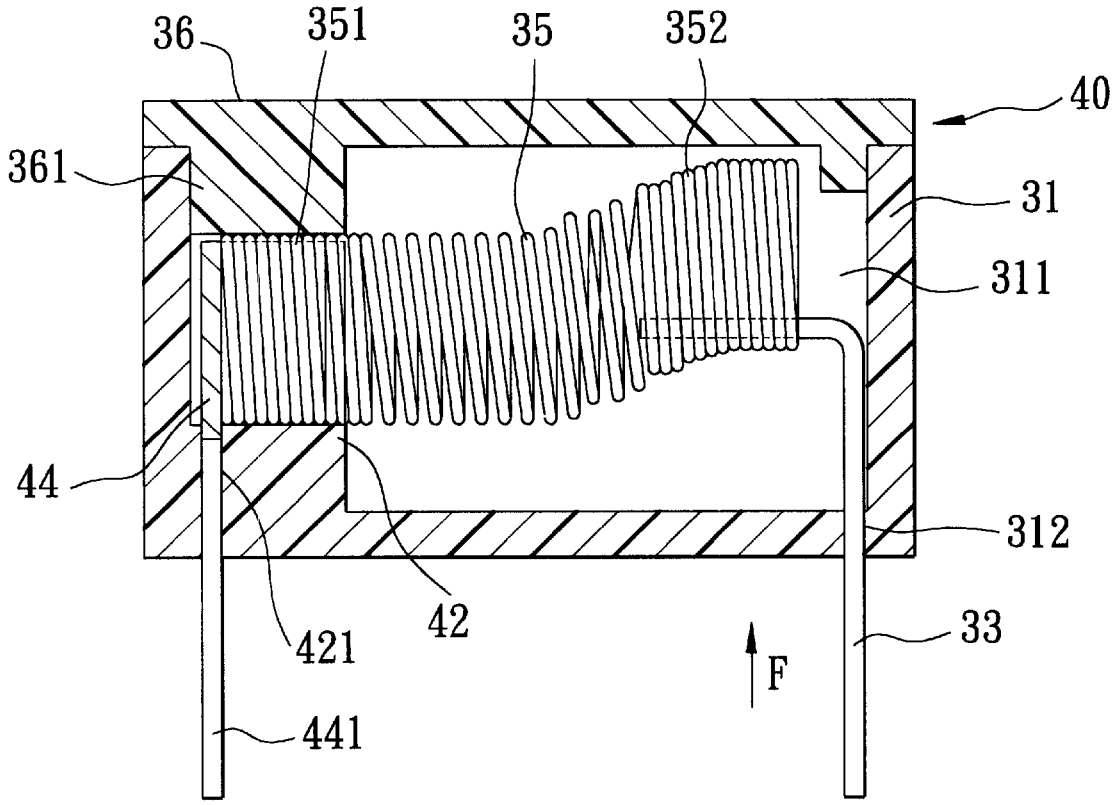

The housing 31 includes first and second side walls and a surrounding wall, which cooperatively confine an accommodation chamber 311 with an upper opening end. A plug member 36 is fittingly and sealingly inserted into the upper opening end, and has a press block 361 extending downwardly therefrom. The second electric contact terminal 33 is L-shaped, and has a second contact end 331 which is disposed in the accommodation chamber 311 and is surrounded by the loops of the contact terminal end 352 of the electric contact body 35, and a second connecting end 332 which extends through a through hole 312 in the surrounding wall in the vicinity of the second side wall and which is bent downwardly from the second contact end 331. A seat portion 32 is disposed in the accommodation chamber 311, and is formed integrally with the surrounding wall in the vicinity of the first side wall. The seat portion 32 has a V-shaped groove 322 and a through hole 321 formed therethrough in the upright direction. The first electric contact terminal 34 has a rod-shaped first connecting end 341 which extends through the through hole 321, and a first contact end 342 with two contact portions which extend in a transverse direction relative to the axis and which are held by the groove 322. The contact portions of the first contact end 342 are inserted between and are in contact with two adjacent loops of the anchoring end 351 of the electric contact body 35. In addition, the press block 361 is disposed to press the anchoring end 351 to prevent movement of the electric contact body 35 along the axis. As shown in FIG. 15, when a force (F) is applied to the housing 31, the contact terminal end 352 is deflected and contacts the second contact end 331 so as to make an electrical connection between the first and second electric contact terminals 34,33.

Referring to FIGS. 16 to 19, the fifth preferred embodiment of the vibration switch 40 according to this invention is shown to be similar to the aforesaid fourth preferred embodiment in construction, except that the seat portion 42 confines a rectangular recess 422, and has an elongate through hole 421 extending in the upright direction. A rod-shaped first connecting end 441 of the first electric contact terminal 44 extends through the through hole 421. A first contact end 442 of the first electric contact terminal 44 is disposed in the recess 422, and includes two side wall portions opposite to each other in the transverse direction, and two contact portions 443 which extend from the side wall portions toward each other and which are inserted between and are in contact with two adjacent loops of the anchoring end 351 of the electric contact body 35. Similarly, a press block 361 of a plug member 36 is disposed to press the anchoring end 351 to prevent movement of the electric contact body 35 along the axis.

By virtue of the aforesaid construction, the vibration switch of this invention can achieve the following advantages:

1. Since the deflectable electric contact body 22,35, which is a coil spring in these preferred embodiments, is separate from the first connecting end 214,341,441 of the first electric contact terminals 25,27,34,44, the terminal 25,27,34,44 can have a diameter greater than 0.5 mm, which is larger than that of the terminal 107 of the conventional vibration switch 1, thereby reducing the risk of deformation and breaking of the same.

2. Moreover, the soldering operation of the terminal 25,27,34,44 on a support, such as a PCB, is convenient to conduct.

3. The housing 21,31 and the plug member 23,36 can ensure firm engagement therebetween, and can be adequately protected from moisture.

4. Since the dimension of the loops of the deflectable electric contact body 22,35 can be increased without influencing the sensitivity of the deflectable electric contact body 22,35, the second contact end 242,331 of the terminal 24,33 can extend in the contact terminal end 222,352 without the need to be positioned to the first side wall 212.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A vibration switch comprising:

a housing adapted to be mounted on a support in an upright direction, and having first and second side walls spaced apart from each other in a longitudinal direction transverse to the upright direction, and a surrounding wall interposed between and cooperating with said first and second side walls to confine an accommodation chamber;

a first electric contact terminal having a first connecting end which extends in the upright direction and which is adapted to be connected to the support, and a first contact end which extends from said first connecting end into said accommodation chamber and which is disposed proximate to said first side wall;

a second electric contact terminal disposed to be electrically insulated from said first electric contact terminal, and having a second connecting end which extends in the upright direction and which is adapted to be connected to the support, and a second contact end which extends from said second connecting end in the longitudinal direction and into said accommodation chamber and which is disposed adjacent to said second side wall and which is spaced apart from said first side wall; and a deflectable electric contact body disposed in said accommodation chamber, and having an anchoring end which anchors on and which is electrically connected to said first contact end, and a deflectable segment which extends from said anchoring end along an axis in the longitudinal direction towards said second side wall and which terminates at a contact terminal end, said deflectable segment being made from a material with a biasing force such that, by means of the biasing force against weight of said deflectable segment, said contact terminal end is held along the axis so as to be spaced apart from said second contact end in radial directions relative to the axis, and being configured such that when said housing is jerked, said contact terminal end is deflected in the radial directions as a result of an inertial force of said deflectable segment so as to contact said second contact end, thereby making an electrical connection between said first and second electric contact terminals.

2. The vibration switch of claim 1, wherein said deflectable electric contact body is a coil spring which is made from an electrically conductive material, and which includes a plurality of loops wound spirally about the axis.

3. The vibration switch of claim 2, wherein two adjacent ones of said loops at said deflectable segment defines a first distance along the axis, two adjacent ones of said loops at said contact terminal end defining along the axis a second distance which is smaller than the first distance.

4. The vibration switch of claim 2, wherein said first side wall has an electrically conductive portion formed thereon, said first contact end being a plug portion which is formed integrally with said electrically conductive portion, which extends along the axis, and which is configured such that said loops at said anchoring end are sleeved on and anchor to said plug portion, said first connecting end being formed integrally with and extending downwardly from said electrically conductive portion.

5. The vibration switch of claim 4, wherein said second side wall has an insulating portion formed thereon, said second contact end extending through said insulating portion into said accommodation chamber along the axis and being configured such that said loops at said contact terminal end surround said second contact end.

6. The vibration switch of claim 5, wherein said plug portion includes four fin portions angularly displaced from one another about the axis and configured to be press-fitted in said loops at said anchoring end along the axis.

7. The vibration switch of claim 2, wherein said second side wall has an electrically conductive portion, said second contact end being disposed on an inner wall surface of said surrounding wall to surround the axis and being integrally formed with said electrically conductive portion, said second connecting end being formed integrally with and extending downwardly from said electrically conductive portion, said first contact end being a rod which is configured such that said loops at said anchoring end are sleeved on and anchor to said rod.

8. The vibration switch of claim 2, wherein said housing is made from an insulating material, said second contact end being a rod which is configured to be surrounded by said loops at said contact terminal end, said second connecting end being bent downwardly from said second contact end and extending through said surrounding wall in the vicinity of said second side wall.

9. The vibration switch of claim 8, further comprising a seat portion which is disposed in said accommodation chamber and which is formed integrally with said surrounding wall, said seat portion being configured to hold said anchoring end along the axis, said first contact end including two contact portions which extend in a transverse direction relative to the axis and which are inserted between and are in contact with two adjacent ones of said loops at said anchoring end, said first connecting end extending downwardly from said contact portions through said surrounding wall in the vicinity of said first side wall.

* * * * *